US008875480B2

(12) United States Patent
Czok et al.

(10) Patent No.: US 8,875,480 B2
(45) Date of Patent: Nov. 4, 2014

(54) METHOD OF PULLING A FILM TUBE OR HOOD DOWN OVER A STACK OF OBJECTS

(75) Inventors: Enrico Czok, Kleve (DE); Reiner Hannen, Kalkar-Wissel (DE)

(73) Assignee: MSK-Verpackungs-Systeme GmbH, Kleve (DE)

( * ) Notice: Subject to any disclaimer, the term of this patent is extended or adjusted under 35 U.S.C. 154(b) by 719 days.

(21) Appl. No.: 13/139,298

(22) PCT Filed: Dec. 12, 2009

(86) PCT No.: PCT/EP2009/008915

§ 371 (c)(1),
(2), (4) Date: Jul. 8, 2011

(87) PCT Pub. No.: WO2010/078915

PCT Pub. Date: Jul. 15, 2010

(65) Prior Publication Data

US 2011/0258973 A1 Oct. 27, 2011

(30) Foreign Application Priority Data

Dec. 19, 2008 (EP) ..... 08022156

(51) Int. Cl.
*B65B 1/04* (2006.01)
*B65B 9/13* (2006.01)

(52) U.S. Cl.
CPC ..... *B65B 9/135* (2013.01)
USPC ..... 53/474; 53/441; 53/459; 53/209

(58) Field of Classification Search
USPC ..... 53/441, 459, 209, 556, 567, 574, 576, 53/577, 585
See application file for complete search history.

(56) References Cited

U.S. PATENT DOCUMENTS

| | | | | |
|---|---|---|---|---|
| 3,522,688 | A | 8/1970 | Kaliwoda | |
| 4,473,990 | A * | 10/1984 | Thimon | 53/567 |
| 6,032,439 | A * | 3/2000 | Birkenfeld et al. | 53/441 |
| 6,470,654 | B1 * | 10/2002 | Lachenmeier et al. | 53/567 |
| 6,865,865 | B2 * | 3/2005 | Hannen et al. | 53/567 |
| 7,234,289 | B2 * | 6/2007 | Hannen et al. | 53/441 |

FOREIGN PATENT DOCUMENTS

| | | | |
|---|---|---|---|
| EP | 0461564 | B | 3/1995 |
| EP | 1266829 | B | 12/2002 |
| FR | 2566739 | A | 1/1986 |

* cited by examiner

*Primary Examiner* — Hemant M Desai
(74) *Attorney, Agent, or Firm* — Andrew Wilford

(57) ABSTRACT

The invention relates to a method for drawing a tubular film (1) over a stack of goods (2), wherein the tubular film is first gathered on a gathering device (R/Ü). The gathered tubular film is then drawn over the stack of goods using a covering device, in that the covering device is moved along the stack of goods and the tubular film is thereby ungathered. After reaching an end region of the stack of goods, the covering device is moved along a segment of the stack of goods (Λ) opposite the covering direction, so that a first tubular film segment (15) is laid on the tubular film already contacting the stack of goods. The covering device is then moved along at least part of the segment of the stack of goods in the covering direction again, so that a second tubular film segment (16) is laid on the first tubular film segment.

12 Claims, 3 Drawing Sheets

2
1
12
9
10
3
14
7
6
11
13
8

1
7
12
9
10
2
6
11
α
13
3
14
8
15

1
2
15
16
A
H
12
9
10
3
14
7
6
11
13
8

METHOD OF PULLING A FILM TUBE OR HOOD DOWN OVER A STACK OF OBJECTS

CROSS REFERENCE TO RELATED APPLICATIONS

This application is the US-national stage of PCT application PCT/EP2009/008915 filed 12 Dec. 2009, published 15 Jul. 2010 as WO2010/078915, and claiming the priority of European patent application 08022156.7 itself filed 19 Dec. 2008.

FIELD OF THE INVENTION

The invention relates to a method of pulling a film tube or hood down over a stack of objects, where the film tube is first gathered on a gathering device and subsequently the gathered film tube is pulled by a pull-down device over the stack of objects by moving the pull-down device along the stack of objects to ungather the film tube with the pull-down device. The invention further relates to an apparatus for pulling a film tube or film hood over a stack of objects.

BACKGROUND OF THE INVENTION

A stack of objects means a plurality of packages, packages, bags or similar items that are advantageously stacked into a parallelopipedal stack of objects. It is within the context of the invention that the stack of objects is carried on a pallet. The stack of objects is covered with a film tube or hood so as to impart to the stack of objects on the one hand a higher stability and on the other to protect the stack of objects against environmental influences. The stack of objects can basically involve a few stacked items but also individual large items, for example household appliances (washing machines, refrigerators, dish washers and the like). The stack of objects does not necessarily have to have a parallelopipedal shape but can basically also have any other shapes. The film tube or film hood to be pulled down over adapts to the shape of the stack of objects.

Methods and apparatuses of the type described above are known from practice in different embodiments. In case of the film tube pulled down over according to the known procedures, the stability of the load, in particular in the lower region of the stack of objects, often leaves a lot to be desired. The attempt has already been made to improve the stability of the load by additional strapping. However, these measures are complicated and often not functionally reliable or cannot be carried out with the desired success.

OBJECT OF THE INVENTION

In contrast, the objet of invention is to provide a method of the above-described type by means of which the stability of the load in particular in the lower region of the stack of objects can be increased in a simple, less complicated and functionally reliable manner. A further object of the invention is to provide a suitable apparatus for carrying out the method.

SUMMARY OF THE INVENTION

For attaining this object, the invention teaches a method of pulling a film tube or film hood over a stack of objects where the film tube is first gathered on a gathering device, the gathering device is used with at least two roller assemblies each with at least one gathering roller and at least two counter rollers, and during gathering the film tube the gathering rollers are engaged with the outside surface of the film tube and only one of the two counter rollers of each roller assembly is engaged with the inside surface of the film tube, subsequently the gathered film tube is pulled by a pull-down device over the stack of objects by moving the pull-down device along the stack of objects to ungather the film tube by the pull-down device, at least during ungathering the film tube when laying first and second tube pieces, the gathering rollers of the roller assemblies are in contact with the outside surface of the film tube and both counter rollers of each roller assembly are in contact with the inside surface of the film tube, after reaching an end region of the stack of objects, the pull-down device is moved along a region of a stack of objects in a direction opposite the pull-down direction so that a first tube piece is laid on the film tube already contacting the stack of objects, and subsequently the pull-down device is moved along at least a portion of the stack of objects in the pull-down direction again so that a second tube piece is laid over the first tube piece.

Furthermore, to attain the object, the invention teaches a method of pulling a film tube or film hood over a stack of objects, where the film tube is first gathered on a gathering device, subsequently the gathered film tube is pulled down over a stack of objects by a pull-down device by moving the pull-down device along the stack of objects thereby ungathering the film tube by the pull-down device, the gathering device or pull-down device has at least two gathering elements via which the film tube ungathered during the pull-down process is guided, after laying a first tube piece, the gathering elements are moved toward the stack of objects so that the spacing of the film tube guided via the gathering elements from the stack of objects decreases and wherein subsequently the pull-down device is moved in the pull-down direction again, after reaching an end region of the stack of objects, the pull-down device is moved along a region of the stack of objects in a direction opposite the pull-down direction so that a first tube piece is laid over the film tube already contacting the stack of objects, and subsequently the pull-down device is moved along at least a portion of the region of the stack of objects in the pull-down direction again so that a second tube piece is laid over the first tube piece.

Moreover, to attain the object, the invention teaches a method of pulling a film tube or film hood over a stack of objects, where the film tube is first gathered on a gathering device (R/Ü), subsequently the gathered film tube is pulled down over a stack of objects by a pull-down device by moving the pull-down device along the stack of objects thereby ungathering the film tube by the pull-down device, the gathering device or pull-down device has at least two gathering elements via which the film tube ungathered during the pull-down process is guided, after reaching an end region of the stack of objects, the gathering elements are moved away from the stack of objects so that the spacing of the film tube guided via the gathering elements from the stack of objects increases, subsequently the pull-down device is moved along a region of the stack of objects in a direction opposite the pull-down direction so that a first tube piece is laid onto the tube piece already contacting the stack of objects, and subsequently the pull-down device is moved again in the pull-down direction along at least a portion of the region of the stack of objects so that a second tube piece is laid over the first tube piece.

Advantageously, the stack of objects is carried on a pallet. End region of the stack of objects means in particular the pallet or the region of the pallet and/or the lower region of the stack of objects arranged directly on the pallet. If the stack of objects is not carried on a pallet, end region of the stack of objects means in particular the lower region of the stack of objects. Furthermore, it is within the context of the invention that the film tube already contacting the stack of objects is in contact with the subsequently laid first tube piece and that the first film tube section in turn is in contact with the second tube piece that is subsequently to be laid. For this, for laying the first tube piece, the film tube is folded upwardly and subsequently for laying the second tube piece, folded downwardly. It is to be understood that at the end of the pull-down process and in particular after laying the second tube piece, the film tube end is ungathered and is laid on the stack of objects or the pallet.

If the stack of objects is on a pallet, it is recommended that the first tube piece be laid along the region A of the stack of objects and along the pallet or along at least a portion of the height of the pallet. Preferably, the second tube piece is laid along at least a portion of the region A of the stack of objects and along the pallet or along at least a portion of the height of the pallet.

It is within the context of the invention that ungathering the film tube is carried out substantially parallel to the movement of the pull-down device in the pull-down direction or, respectively, in the direction opposite the pull-down direction when pulling the film tube over the stack of objects or when laying the tube pieces. According to a particularly recommended embodiment of the invention, a continuous ungathering from the pull-down device takes place during the movement of the pull-down device in the direction opposite the pull-down direction when laying the first tube piece and during the movement of the pull-down device in the pull-down direction when laying the second tube piece. In a particularly advantageous configuration of the invention it is provided that the ungathering speed or, respectively, the rotational speed of the driven gathering rollers is variably adjustable.

The film tube or the film hood advantageously consists of an elastic plastic film. Insofar as here and hereinafter a film hood is mentioned, this is to be understood as the film tube that is already cut off and welded on one end.

Advantageously, within the context of the method according to the invention, the film tube is fed from a tube supply. It is recommended that in the supply state, the side edges of the film tube are folded inwardly. This is called gusseted tubing. It is within the context of the invention that the fed film tube is opened above or in front of the stack of objects. Advantageously, gathering elements of the gathering device are subsequently inserted into the film tube end of the opened film tube so that the inside surface of the film tube end rests against the gathering elements. Each gathering element preferably has a gathering bar that advisably extends transverse to the feed direction of the film tube or transverse to the vertical. After inserting the gathering elements, the inside surface of the film tube end rests against the gathering bar. According to a particularly preferred embodiment of the invention, the gathering elements are arranged with their gathering bars at the four corners of an opened film tube having a rectangular cross-section. In this case, the gathering bars are also designated as gathering corners. It is within the context of the invention that the gathering elements or gathering bars are displaceable transverse to the feed direction of the tubular foil, in particular horizontally, namely preferably displaceable independently of each other. Furthermore, it is within the context of the invention that the gathering elements or gathering bars are displaceable in the feed direction of the film tube, in particular in the vertical direction. The gathering elements or gathering bars are advisably connected to a frame that is displaceable in the feed direction of the film tube, in particular in the vertical direction.

According to the invention, a gathering device comprising at least two roller assemblies each with at least one gathering roller and at least two counter rollers is used and, according to the invention, during gathering the film tube, the gathering rollers are engaged with the outside surface of the film tube and only one of the two counter rollers of each roller assembly is engaged with the inside surface of the film tube. It is within the context of the invention that each gathering element or each gathering bar is associated with such a roller assembly. Then, the counter roller that is in contact with the inside surface of the film tube during gathering is preferably arranged in each case downstream of or below the associated gathering bar with respect to the feed direction of the film tube, in particular arranged below the associated gathering bar with respect to the vertical. Advantageously, after inserting the gathering elements into the opened film tube end, the gathering rollers are moved closer or tilted so that each gathering roller and its associated counter roller grip the film tube in a clamping manner. Preferably, the gathering rollers are driven during gathering the film tube and to this end, preferably, each gathering roller is associated with a drive motor. Advisably, the counter rollers are not driven and function as another pinch roller with respect to the associated gathering rollers. As explained below, it is within the context of the invention that each roller assembly has a further counter roller that, however, is advantageously not in contact with the inside surface of the film tube during gathering. For this, the further counter roller, for example, can be tilted away from the associated gathering roller. Preferably, the roller assemblies are oriented during gathering in such a manner that the rotation axis of the counter roller contacting the film tube is arranged downstream of the rotation axis of the gathering roller with respect to the feed direction of the film tube or arranged below the rotation axis of the gathering roller with respect to the vertical.

It is within the context of the invention that a tube piece provided for forming the film hood is pulled off the tube supply and is gathered in front of or above the stack of objects. Advantageously, two gathering elements or gathering bars, preferably four gathering elements or gathering bars are inserted here into the opened film tube end. Advisably, each gathering element or gathering bar is associated with a roller assembly through which the film tube is guided during gathering and is gathered downstream of the roller assembly with respect to the feed direction. During gathering, the film tube is gathered in a manner known per se into a bellow-like or accordion-like shape. Due to the above-described preferred arrangement of the rotational axes of the rollers, a very uniform fold formation can be achieved during gathering, wherein each of the folds point diagonally downward and (with respect to the stack of objects) toward the outside surface. When subsequently pulling the film hood over the stack of objects, this uniform alignment of the folds makes it possible to pull off fold by fold in a simple, functionally reliable and damage-free manner. Advantageously, the apparatus for carrying out the method according to the invention has a cutting device and a welding device by means of which, after gathering, the film tube is cut off and welded at the upper end of the film hood to be formed thereby forming the film hood.

According to a particularly preferred embodiment of the method according to the invention, the film tube is transversely stretched after gathering. Advantageously, the transverse stretching is carried out with the gathering device. Preferably, the gathering elements are also used here as transverse stretching elements by means of which the film tube or the film hood is transversely stretched after gathering and advantageously prior to pulling it over the stack of objects. The transverse stretching is carried out with the proviso that the cross-section or horizontal cross-section of the transversely stretched film tube is larger than the cross-section or horizontal cross-section of the stack of objects. After the gathering and after the transverse stretching, the film tube is pulled down over the stack of objects by means the pull-down device.

According to a very preferred embodiment of the invention, the gathering device is used as pull-down device. When being pulled down over the stack of objects, the film tube is ungathered by the gathering device or pull-down device and is guided via the gathering elements or gathering bars before it comes to rest on the stack of objects. It has already been explained that advisably four gathering elements or four gathering bars are involved that are preferably arranged at the four corners of the film tube having a rectangular cross-section. For the pull-down process, the gathering elements or gathering bars are displaceable in the pull-down direction of the film hood or, respectively, in the vertical direction. For this, the gathering elements are advantageously connected to a frame that is displaceable in the pull-down direction of the film hood or, respectively, in the vertical direction.

It is within the context of the invention that ungathering the film tube when being pulled down over the stack of objects is supported by the roller assemblies. It is further within the context of the invention that the roller assemblies are also connected to the frame and are displaceable with the frame in the pull-down direction of the film hood or, respectively, in the vertical direction. According to a very preferred embodiment of the method according to the invention, the gathering rollers of the roller assembly are in contact with the outside surface of the film tube at least during ungathering the film tube when laying the first and the second tube pieces and both counter rollers of each roller assembly are in contact with the inside surface of the film tube. A particularly preferred embodiment of the invention is characterized in that during the entire ungathering process of the film tube and when pulling the same over the stack of objects, the gathering rollers of the roller assembly are in contact with the outside surface of the film tube and both counter rollers are in contact with the inside surface of the film tube. Advantageously, the gathering rollers are driven during ungathering the film tube in the ungathering direction. Preferably, the rotational speed or the circumferential speed of the gathering rollers is slower or slightly slower than the speed of the pull-down movement/downward movement of the gathering device/pull-down device. In this manner, a vertical stretch can be generated in the film tube.

According to a particularly preferred embodiment of the invention, prior to being laid on the stack of objects, the film tube is held in a clamping manner between the gathering roller and the two counter rollers of each roller assembly during ungathering when being pulled down over the stack of objects. Advisably, during ungathering, the rotation axis of the first counter roller is arranged downstream of the gathering roller with respect to the ungathering direction or, respectively, is arranged above the rotation axis of the gathering roller with respect to the vertical. Preferably, the rotation axis of the second counter roller is arranged upstream of the rotation axis of the gathering roller with respect to the ungathering direction or, respectively is arranged below the rotation axis of the gathering roller with respect to the vertical. It is within the context of the invention that the preferred geometrical arrangement is implemented in all roller assemblies during ungathering the film tube. This applies in particular also during ungathering the film tube when laying the first and the second tube pieces.

When during ungathering, pull-down and laying the film tube on the stack of objects, the end region of the stack of objects is reached, the film tube is folded upwardly for generating the first tube piece. End region of the stack of objects is to be understood here in particular as a pallet on which the stack of objects is arranged and primarily the intermediate pallet bottom or lower pallet bottom of the pallet on which the stack of objects is arranged. However, the end region of the stack of objects can basically also be the lower region or the lower edge of the stack of objects. According to the invention, after the end region is reached, the gathering elements of the pull-down device are moved away from the stack of objects horizontally so that the spacing of the film tube guided via the gathering elements from the stack of objects increases. The above-described transverse movement of a gathering element prior to folding the film tube preferably takes place over 50 to 150 mm, preferred over 80 to 120 mm and particularly preferred over approximately 100 mm. Subsequent to the transverse movement of the gathering elements, according to the invention, the pull-down device is moved along a region of the stack of objects in a direction opposite the pull-down direction or, respectively, is moved upwardly so that the first tube piece is ungathered and is laid along the mentioned region of the stack of objects over the film tube already contacting the stack of objects. The height H of the first tube piece is preferably at least $1/20$, preferred at least $1/15$, very preferred at least $1/10$ and particularly preferred at least $1/8$ of the height of the stack of objects or the height of the stack of objects with the pallet. Advisably, the height or, respectively, width of the first tube piece is at least 100 mm and preferred 200 to 500 mm.

It is within the context of the invention that after folding over and laying the first tube piece over the film tube already contacting the stack of objects, a further folding in the downward direction takes place so that in this manner, the second tube piece is formed or ungathered and is laid over the first tube piece. According to the invention, after laying the first tube piece, the gathering elements of the pull-down device are moved horizontally toward the stack of objects so that the spacing of the film tube guided via the gathering elements from the stack of objects decreases and that subsequently for ungathering and laying the second tube piece, the pull-down device is moved in the pull-down direction again. The above-described horizontal movement or transverse movement of a gathering element prior to folding over the film tube a second time advantageously takes place over 20 to 80 mm, preferably over 35 to 65 mm and preferred over approximately 50 mm. According to a preferred embodiment of the invention, the height H of the second tube piece corresponds to the height H of the first tube piece or approximately to the height H of the first tube piece. It is recommended that the film tube is released by the pull-down device after laying the second tube piece. Apart from that, it is within the context of the invention that the film tube and the first tube piece as well as the second tube piece extend over the entire circumference of the stack of objects. At least during ungathering the film tube when laying the first tube piece and during ungathering the film tube when laying the second tube piece, the counter rollers are arranged with the proviso that the film tube wraps around the gathering roller with a wrap angle α. Advantageously, the wrap angle α is 25° to 60°, preferably 30° to 50° and particularly preferred 35° to 45°, in particular approximately 40°. It is within the context of the invention here that the diameters of the counter rollers are set up with the proviso that the above-described wrap angle can be implemented. Preferably, the arrangement of the counter rollers and the mentioned wrap angle are also implemented during ungathering the film tube when pulling the same over the stack of objects prior to folding over to form the first tube piece.

The above-described contact of the film tube with the gathering roller and the two counter rollers and in particular the specified wrap angles have proved to be particularly effective. This applies primarily for the ungathering process when laying the first tube piece or during the movement of the pull-down device in a direction opposite the pull-down direction. Here, the vertical force acting on the film tube when pulling the same over the stack of objects does not exist anymore and ungathering is much more difficult. This applies in particular to film tubes that have a high friction coefficient on their inside or a friction coefficient that is higher than the one on their outside. Nevertheless, when complying with the teaching according to the invention, a simple, problem-free and functionally reliable ungathering is possible even when laying the first tube piece and also when laying the second tube piece.

To attain the object, the invention further teaches an apparatus for pulling a film tube or film hood over a stack of objects by a gathering device for gathering the film tube and by a pull-down device for ungathering and for pulling the film tube over the stack of objects, where with the pull-down device, at least one tube piece connected to the film tube already contacting the stack of objects can be folded over and can be laid on the film tube contacting the stack of objects, the pull-down device has at least two roller assemblies each with at least one gathering roller and each with at least two counter rollers and wherein during ungathering the film tube for laying the at least one tube piece, the gathering roller and the two counter rollers can be engaged with the ungathered film tube. The gathering roller of each roller assembly is in contact here with the outside surface of the film tube and the two counter rollers of each roller assembly are each in contact with the inside surface of the film tube.

As already explained above, the gathering device can be used as pull-down device for ungathering and for pulling the film tube over the stack of objects. In this case, the gathering device and the pull-down device are thus the same device.

According to a preferred embodiment of the device according to the invention, at least two gathering elements are provided that each are associated with one roller assembly, wherein the gathering elements each have at least one gathering bar via which the film tube is guided during gathering and ungathering, and wherein a first (upper) counter roller of each roller assembly is arranged during ungathering the film tube at the height of the gathering bar and preferably protrudes above the associated gathering bar or protrudes slightly above the same. Advisably, the mentioned first (upper) counter roller protrudes several millimeters upward from the surface of the gathering bar.

The invention is based on the knowledge that with the method according to the invention and with the device according to the invention, a particularly effective securing of the load or stability of the load can be achieved for a stack of objects over which a film tube is pulled. It is to be emphasized here that the method according to the invention can be carried out in a relative simple and less costly as well as functionally reliable manner. Of particular importance within the context of the invention is the embodiment according to which during the ungathering and pull-down process of the film tube, the gathering roller and the two associated counter rollers of each roller assembly are in contact with the ungathered film tube. In this manner, a particularly controlled and functionally reliable ungathering especially during the generation of the first and the second tube pieces can be achieved. This applies in particular also for the use of film tubes that have a high friction coefficient on their inner surface or, respectively, have a higher friction coefficient on their inner surface than on their outer surface. Such film tubes are primarily used in the beverage industry so as to achieve a friction coefficient on the load as high as possible. This is intended to increase the security of the load because due to the adequate adhesion on the stack of objects, the film tubes lose the desired initial tension during transport or during storage less quickly. The invention is based on the knowledge that such film tubes having roughened inner surfaces create problems during ungathering the film tube and particularly when folding tube pieces. With the device according to the invention and the method according to the invention, these problems do not occur and gathering and folding the film tube is possible in a simple and functionally reliable as well as damage-free manner.

BRIEF DESCRIPTION OF THE DRAWING

The invention is explained in more detail below with reference to a drawing illustrating only one embodiment. In the figures.

SPECIFIC DESCRIPTION OF THE INVENTION

Figure 1:
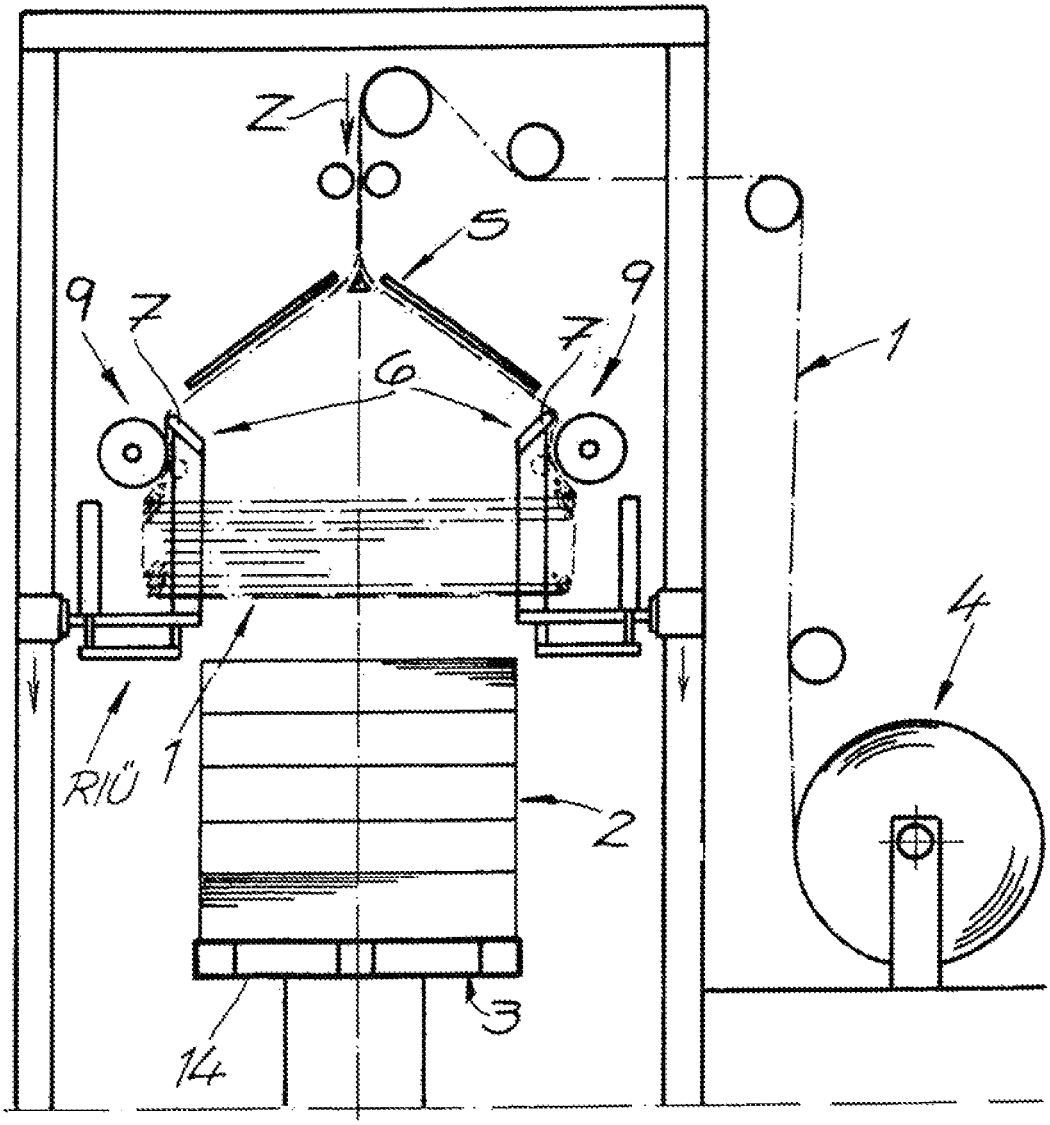
FIG. 1 is a schematic side view of an apparatus according to the invention.

The figures show an apparatus for pulling a film tube 1 over a stack 2 of objects. Hereinafter, the term film tube 1 is generally used although according to a preferred embodiment, the film tube 1 is cut and welded into a film hood. The stack 2 of objects may be formed by a plurality of packages that are stacked on a pallet 3 to form a parallelopiped.

Within the context of the method according to the invention, the film tube 1 is first fed from a tube supply 4 and is spread by an opener 5 above the stack 2 of objects. Subsequently four gathering elements 6 are introduced into the opened film tube 1 so that the inside surface of the film tube 1 rests on the gathering elements 6. Preferably in this embodiment, the gathering elements 6 are arranged at the four corners of an opened or stretched film tube 1. Advantageously in this embodiment, the gathering elements 6 each have a curved gathering bar 7 that extends transverse to feed direction Z of the film tube 1 as well as to a vertical wall 8 adjacent the gathering bar 7.

FIG. 1 shows that prior to pulling it over the stack 2 of objects, the film tube 1 is first gathered on a gathering device R/Ü. To this end, each gathering element 6 is associated with a respective roller assembly 9 consisting of a gathering roller 10 and a counter roller 11. Each roller assembly 9 has also a further counter roller 12 that is not illustrated in FIG. 1. Preferably in this embodiment, the further counter roller 12 is not as described below involved in gathering, but is used during ungathering and pulling the film tube 1 over the stack 2 of objects. The film tube 1 is pulled off the tube supply 4, is guided by the gathering bars 7 and is passed between the respective gathering roller 10 and counter roller 11. Here, the gathering rollers 10 are preferably driven by a motor 13, whereas the counter rollers 11 are not driven and act only as pinch rollers. Advisably in this embodiment, the gathering rollers 10 are of larger diameter than the counter rollers 11 and 12. Advantageously in this embodiment, the gathering roller 10 and the counter roller 11 of each roller assembly are oriented during ungathering in such a manner that the rotation axis of the counter roller 11 is downstream of the rotation axis of the associated gathering roller 10 with respect to the feed direction of the film tube 1 or is below the rotation axis of the associated gathering roller 10 with respect to the vertical. After passing through the roller assemblies 9, the film tube 1 is gathered below the roller assemblies 9. After the gathering of the film tube 1, the film tube 1 is advantageously cut off at its upper end by a non-illustrated cutting device and is welded by a non-illustrated welding device so that a film hood is formed that subsequently can be pulled down over the stack 2 of objects.

Figure 2:
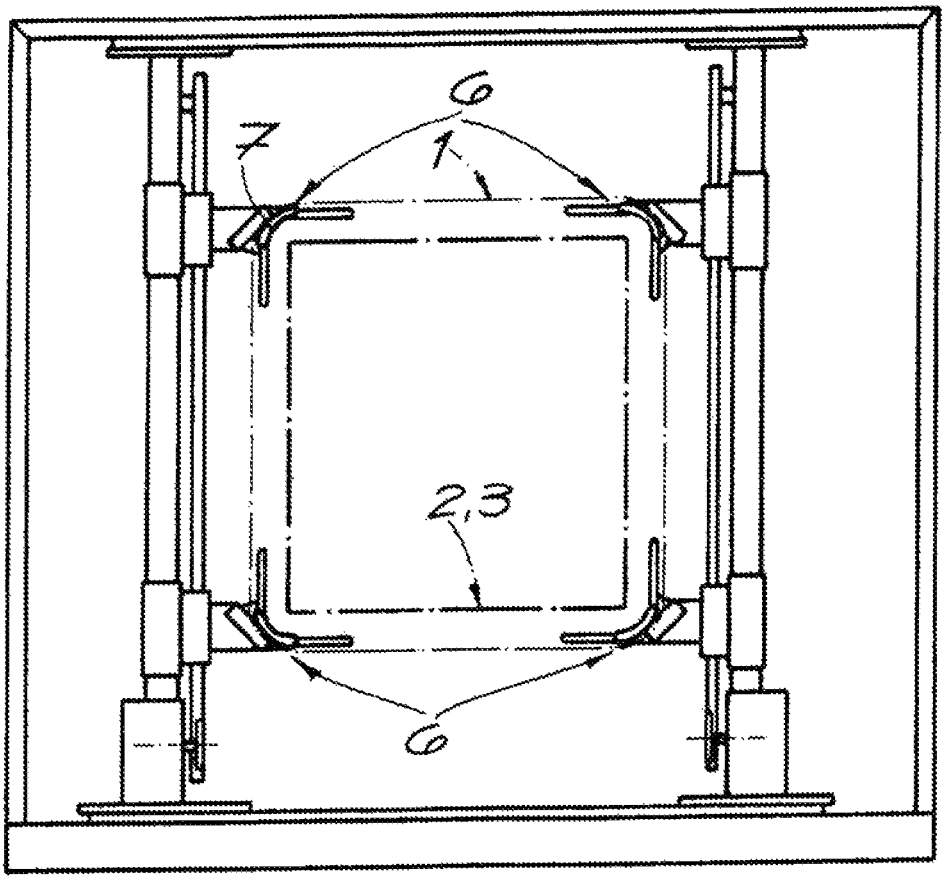
FIG. 2 is a sectional view from above onto the subject matter of FIG. 1.

According to a preferred embodiment of the invention, the gathered film tube 1 is transversely stretched so that its horizontal cross-section is larger than the horizontal cross-section of the stack 2 of objects. Preferably, the gathering elements 6 or the gathering bars 7 are used here as transverse stretching elements, and for transversely stretching the film tube 1, the gathering elements 6 are moved diagonally away from each other. FIG. 2 shows the gathering elements 6 after the transverse stretching above the stack 2 of objects. After gathering and transverse stretching, the film tube is pulled down over the stack 2 of objects. Preferably in this embodiment, the gathering device R/Ü is also used here as pull-down device R/Ü and the film tube, when being pulled down over the stack 2 of objects, is ungathered by the pull-down device R/Ü. The pull-down device R/Ü is substantially formed by a vertically displaceable frame to whose four corners the gathering elements 6 and the roller assemblies 9 are connected. Thus, when pulling the film tube 1 down over the stack 2 of objects, the gathering elements 6 and the roller assemblies 9 are displaced with the frame or displaced downwardly.

Figure 3:
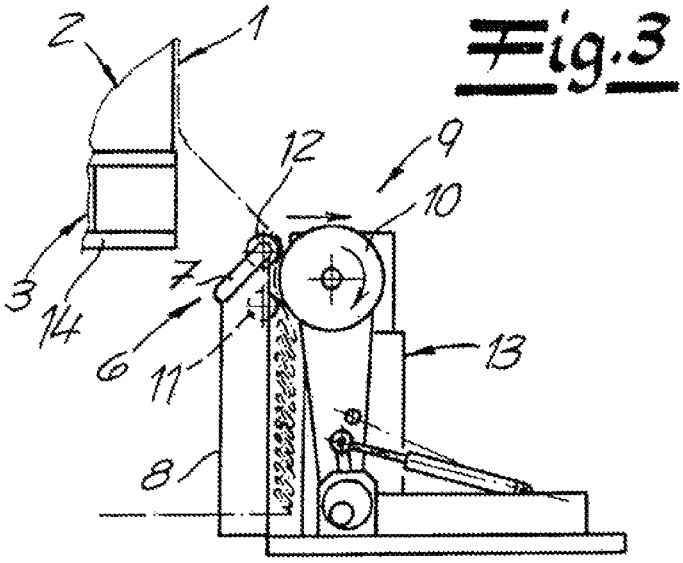
FIG. 3 is a detail of FIG. 1 in the region of a roller assembly in a first operating position.
Figure 4:
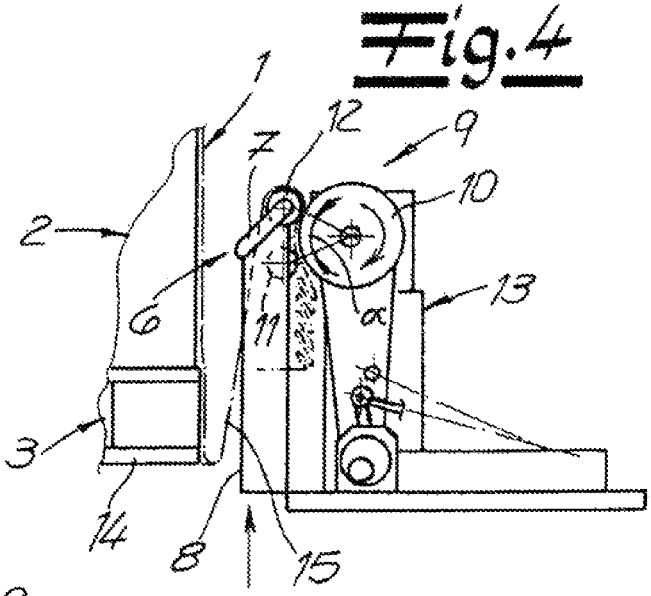
FIG. 4 is a view like FIG. 3 in a second operating position.
Figure 5:
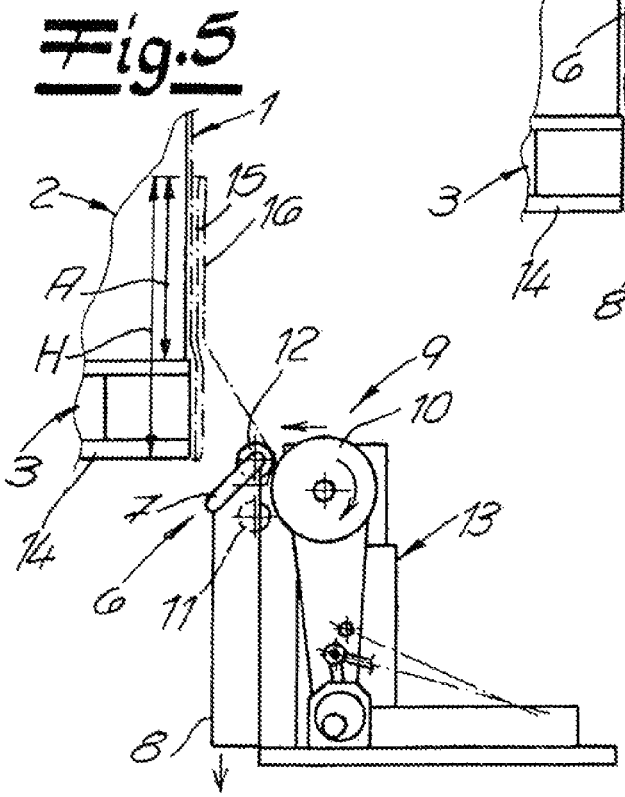
FIG. 5 is a view like FIG. 3 in a third operating position.

When being pulled down over the stack 2 of objects, the gathered film tube 1 is ungathered again, and the folds of the gathered film tube 1 are gradually pulled out or unfolded. It is within the context of the invention that during ungathering of the film tube 1, the gathering roller 10 and both counter rollers 11 and 12 of each roller assembly are in contact with the film tube 1. FIG. 3 shows in particular that the gathering roller 10 of each roller assembly is in contact with the outside surface of the film tube 1 while the two counter rollers 11 and 12 are in contact with the inside surface of the film tube 1. Thus, the gathering roller 10 and counter rollers 11 and 12 grip the ungathered film tube 1. Thus, during ungathering of the film tube 1, the gathering roller 10 of each roller assembly 9 acts against both counter rollers 11 and 12. Advantageously, during ungathering the film tube 1, the gathering rollers 10 are each driven by a drive motor 13, namely in the rotational sense indicated by an arrow in FIGS. 3 to 5. In contrast, the counter rollers 11 and 12 are advantageously not driven during ungathering and act only as pinch rollers with respect to the gathering roller 10. According to a preferred embodiment, the rotational or the circumferential speed of the gathering rollers 10 is slightly lower than the pull-down speed of the pull-down device R/Ü. Hence, the film tube 1 can be vertically stretched. As shown in FIGS. 3 to 5, the film tube 1 is guided during ungathering through the roller assemblies 9 and via the gathering bars 7 of the gathering elements 6.

FIGS. 3 to 5 further show that during the ungathering and pull-down process of the film tube 1, the rotation axis of the first upper counter roller 12 is preferably downstream of the rotation axis of the gathering roller 10 with respect to the ungathering direction or above the rotation axis of the gathering roller 10 with respect to the vertical. Advisably in this embodiment, furthermore, the rotation axis of the second lower counter roller 11 is upstream of the rotation axis of the gathering roller 10 with respect to the ungathering direction or below the rotation axis of the gathering roller 10 with respect to the vertical. Preferably in this embodiment, the diameter of the gathering roller 10 of the roller assemblies 9 is larger or significantly larger than the diameters of the counter rollers 11 and 12. The first upper counter roller 12 is preferably at the height of the gathering bar 7 of a gathering element 6 and preferably in this embodiment protrudes slightly upward past the gathering bar 7.

FIG. 3 shows that after pulling the film tube 1 over the stack 2 of objects, the pull-down device R/Ü with the gathering elements 6 and roller assemblies 9 has reached the end or lower region of the stack of objects. In this embodiment, the upper counter roller 12 of each roller assembly 9 is located at the height of the bottom 14 of the pallet 3. Subsequently the items consisting of gathering elements 6 and roller assemblies 9 are moved horizontally away from the stack 2 of objects as indicated by the arrow in FIG. 3 so that the spacing of the film tube 1 guided via the gathering elements 6 from the stack 2 of objects increases. After this, the pull-down device R/Ü with the gathering elements 6 and roller assemblies 9 is moved upward in a direction opposite the pull-down direction so that the film tube 1 is folded upward and a first tube piece 15 is formed. After ungathering, the first tube piece 15 is laid along a region A of the stack of objects and along the pallet 3 over the film tube 1 already contacting the stack 2 of objects and the pallet 3. Apart from that, FIG. 4 shows that the film tube 1 wraps around the gathering roller 10 with a wrap angle $\alpha$ that preferably in this embodiment is 40° or approximately 40°.

Once the desired height H of the first tube piece 15 is reached, advantageously, the gathering elements 6 and roller assemblies 9 are moved again horizontally toward the stack of objects so that the spacing of the film tube 1 guided via the gathering elements 6 from the stack 2 of objects decreases again. After this, the pull-down device R/Ü with the items consisting of gathering elements and roller assemblies 9 is moved downward in the pull-down direction again so that the film tube 1 is folded downward and a second tube piece 16 is formed. The second tube piece 16 is then laid over the first tube piece 15. After laying the second tube piece 16, the film tube 1 is released by the pull-down device R/Ü.

By means of the folded tube pieces 15 and 16, a very effective securing of the load is achieved. The tube pieces 15 and 16 can be generated in a simple, functionally reliable and unconstrained manner in that during ungathering the film tube 1 is in contact with the gathering roller 10 as well as the two counter rollers 11 and 12.

The invention claimed is:

1. A method of pulling a film tube or a film hood over a stack of objects, the method comprising the steps of:

gathering the film tube on a gathering device having at least two roller assemblies each with one respective gathering roller and two respective counter rollers;

during gathering of the film tube, engaging the gathering rollers with an outside surface of the film tube and engaging only one of the two counter rollers of each roller assembly with an inside surface of the film tube;

thereafter pulling the gathered film tube in a pull-down direction by a pull-down device over the stack of objects by moving the pull-down device along the stack of objects and thereby ungathering the film tube by the pull-down device;

at least during ungathering of the film tube, engaging the gathering rollers of the roller assemblies with the outside surface of the film tube and both counter rollers of each roller assembly with the inside surface of the film tube;

after reaching an end region of the stack of objects moving the pull-down device along a region of the stack of objects in a direction opposite the pull-down direction so that a first tube piece is laid over the film tube already contacting the stack of objects; and thereafter moving the pull-down device along at least a portion of the region of the stack of objects in the pull-down direction again so that a second tube piece is laid over the first tube piece.

2. The method defined in claim 1, wherein the gathering device or pull-down device has at least two gathering elements via which the film tube ungathered during the pull-down process is guided.

3. A method of pulling a film tube or a film hood over a stack of objects, the method comprising the steps of:

gathering the film tube on a gathering device;

thereafter pulling the gathered film tube down over a stack of objects by a pull-down device by moving the pull-down device in a pull-down direction along the stack of objects and thereby ungathering the film tube by the pull-down device, the gathering or pull-down device having at least two gathering elements via which the film tube ungathered during the pull-down process is guided;

after reaching an end region of the stack of objects, the pull-down device is moved along a region of the stack of objects in a direction opposite the pull-down direction so that a first tube piece is laid over the film tube already contacting the stack of objects, after laying a first tube piece, the gathering elements are moved toward the stack of objects so that the spacing of the film tube guided via the gathering elements from the stack of objects decreases;

thereafter moving the pull-down device in the pull-down direction again; and thereafter the pull-down device is moved along at least a portion of the region of the stack of objects in the pull-down direction again so that a second tube piece is laid over the first tube piece.

4. The method defined in claim 3, further comprising the step of after reaching the end region of the stack of objects, moving the gathering elements away from the stack of objects so that the spacing of the film tube guided via the gathering elements from the stack of objects increases; and thereafter moving the pull-down device in a direction opposite the pull-down direction.

5. A method of pulling a film tube or a film hood over a stack of objects, the method comprising the steps of:

gathering the film tube gathered on a gathering device;

thereafter pulling the gathered film tube down over a stack of objects by a pull-down device by moving the pull-down device along the stack of objects and thereby ungathering the film tube by the pull-down device, the gathering or pull-down device having at least two gathering elements via which the film tube ungathered during the pull-down process is guided, after reaching an end region of the stack of objects, moving the gathering elements away from the stack of objects so that the spacing of the film tube guided via the gathering elements from the stack of objects increases;

thereafter moving the pull-down device opposite to the pull-down direction along a region of the stack of objects so that a first tube piece is laid over the film tube already contacting the stack of objects; and thereafter moving the pull-down device along at least a portion of the region of the stack of objects in the pull-down direction again so that a second tube piece is laid over the first tubular segment.

6. The method defined in claim 5, wherein a gathering device is used that has at least two roller assemblies each with at least one gathering roller and at least two counter rollers and wherein during gathering the film tube, the gathering rollers being engaged with the outside surface of the film tube and only one of the two counter rollers of each roller assembly is engaged with the inside surface of the film tube.

7. The method defined in claim 5, wherein after laying the first tube piece, the gathering elements are moved toward the stack of objects so that the spacing of the film tube guided via the gathering elements from the stack of objects decreases and wherein thereafter the pull-down device is moved in the pull-down direction again.

8. The method defined in claim 5, wherein at least during ungathering the film tube when laying the first and the second tube pieces, the gathering rollers of the roller assemblies are in contact with the outside surface of the film tube and both counter rollers of each roller assembly are in contact with the inside surface of the film tube.

9. The method defined in claim 5, wherein the film tube is transversely stretched after gathering.

10. The method defined in claim 5, wherein the gathering device is used as the pull-down device.

11. The method defined in claim 6, further comprising, at least during ungathering of the film tube, the step of:

positioning the roller assemblies such that the film tube wraps around the gathering rollers with a wrap angle between 25° and 60°.

12. The method defined in claim 5, wherein after laying the second tube piece the film tube is released by the pull-down device.

* * * * *